US009157682B2

(12) United States Patent
Malas

(10) Patent No.: US 9,157,682 B2
(45) Date of Patent: Oct. 13, 2015

(54) FURNACE ATMOSPHERE GENERATOR

(75) Inventor: Akin Malas, Munich (DE)

(73) Assignee: Linde Aktiengesellschaft, Munich (DE)

( * ) Notice: Subject to any disclaimer, the term of this patent is extended or adjusted under 35 U.S.C. 154(b) by 224 days.

(21) Appl. No.: 13/362,009

(22) Filed: Jan. 31, 2012

(65) Prior Publication Data

US 2013/0026685 A1 Jan. 31, 2013

(30) Foreign Application Priority Data

Feb. 10, 2011 (EP) ..... 11001092

(51) Int. Cl.
*C21D 1/00* (2006.01)
*F27D 7/06* (2006.01)
*C21D 1/76* (2006.01)

(52) U.S. Cl.
CPC . *F27D 7/06* (2013.01); *C21D 1/763* (2013.01)

(58) Field of Classification Search
CPC ..... C21D 1/76; C21D 1/763; F27D 7/06; F27D 7/02
USPC ..... 266/44, 257
See application file for complete search history.

(56) References Cited

U.S. PATENT DOCUMENTS

| | | | | |
|---|---|---|---|---|
| 4,139,375 | A | 2/1979 | Solomon et al. | |
| 4,279,406 | A * | 7/1981 | Bourhis et al. | 266/81 |
| 4,436,289 | A * | 3/1984 | Connelly et al. | 266/80 |
| 4,643,402 | A * | 2/1987 | Brahmbhatt | 266/82 |
| 4,805,881 | A * | 2/1989 | Schultz et al. | 266/257 |
| 5,160,380 | A | 11/1992 | Vocke et al. | |
| 5,968,457 | A | 10/1999 | Van Den Sype et al. | |
| 2013/0026685 | A1 * | 1/2013 | Malas | 266/44 |

FOREIGN PATENT DOCUMENTS

| | | |
|---|---|---|
| EP | 0 430 314 A2 | 6/1991 |
| JP | 63 319201 A | 12/1988 |

OTHER PUBLICATIONS

European Search Report, Oct. 18, 2011.
Database WPI, Week 198906, Thomson Scientific, London, GB, AN 1989-044756, XP002660825.
International Search Report for EP 11 00 1092, Date of Mailing: Oct. 18, 2011, Authorized Officer: Stefano Peis, 6 pp.
European Search Report for EP 12 00 0612, Date of Mailing: Apr. 3, 2012, Authorized Officer: Stefano Peis, 7 pp.

* cited by examiner

*Primary Examiner* — Scott Kastler
(74) *Attorney, Agent, or Firm* — Joshua L. Cohen

(57) ABSTRACT

A heat treatment furnace is provided which includes a gas generator with a methanol inlet connected to a methanol feed line and at least one gas outlet for dissociated methanol, wherein said gas generator is disposed to be in heat exchange contact with a cooling zone and a heating zone of the furnace.

31 Claims, 3 Drawing Sheets

FURNACE ATMOSPHERE GENERATOR

Figure 1:
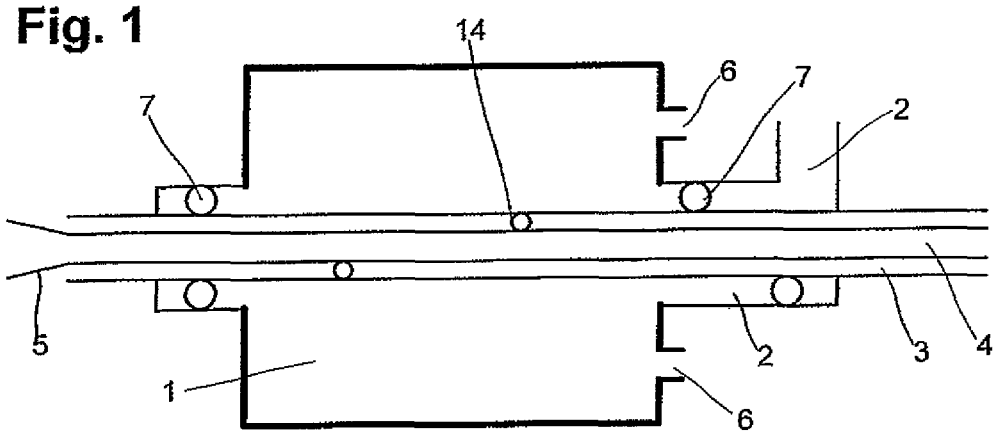

The invention relates to a heat treatment furnace and a method to provide a heat treatment atmosphere in a furnace.

In the prior art there are already heat treatment processes known which involve the use of a reactor placed inside the heat treatment furnace. For example, U.S. Pat. No. 5,160,380 relates to a process and apparatus for preparation of treatment gas used in heat treatments, whereby the treatment gas is produced in a furnace disposed catalyst retort at a temperature of that of the furnace in which the retort is positioned.

However, such equipment is often complex and requires high maintenance.

It is also known to inject methanol into a furnace and to let the methanol dissociate. However, for example in sintering furnaces this method is not practical since due to the structure of the sintering furnace with ceramic and metal retorts or muffles drilling holes to employ proper nozzles proves impractical. There is also a risk that liquid methanol could reach the furnace components or the sintered parts and damage them. Further, when liquid methanol sits on the components it could improperly dissociate and generate unwanted atmosphere constituents. Another disadvantage of direct injection of liquid methanol is the endothermic character of the dissociation reaction which takes away heat and could cause issues in the sintered components, e.g. decarburisation or partial oxidation.

It is an object of the present invention to provide a method and an apparatus for producing a heat treatment atmosphere. Another object is to provide a method and an apparatus for providing a furnace atmosphere without too complex a structure.

The object is achieved by a heat treatment furnace including a heating zone and a cooling zone and a gas generator with a methanol inlet connected to a methanol supply via a methanol feed line and one or more gas outlets for dissociated methanol, wherein said gas generator is installed in the contact area of the heating zone and the cooling zone.

According to the inventive method to provide a heat treatment atmosphere in a furnace having a heating zone and a cooling zone, methanol is supplied to a gas generator and said methanol is dissociated in said gas generator to produce CO and $H_2$ and said CO and $H_2$ are introduced into said furnace, wherein said gas generator is installed in the contact area of the heating zone and the cooling zone and said gas generator is heated by the atmosphere within said furnace.

The term "gas generator" shall mean a unit or device for generating and/or supplying gas to a heat treatment furnace. The term "gas" shall also cover gas mixtures. The gas generator shall preferably be designed with a reactor or reaction chamber for dissociation of methanol in the form of a box, block, chamber, vessel or an enclosure. The reactor has preferably walls with a high thermal conductivity in order to improve the heat transfer from the furnace and/or from the furnace atmosphere to and into the reactor. The gas generator may comprise additional gas feed lines which may supply gas to the reactor and/or directly into the furnace and/or to a second reactor or to another gas treatment unit.

The invention is based on the idea to create the furnace atmosphere or gaseous components of the furnace atmosphere in a gas generator and to make use of the already available heat in the furnace. The heat required for the dissociation of methanol is taken from the furnace atmosphere and/or from the furnace itself. According to the inventive apparatus the dissociation takes place in the reactor of the gas generator, i.e. not directly in the furnace. The reaction products, i.e. carbon monoxide (CO) and hydrogen ($H_2$), are fed into the furnace and any non-dissociated methanol remains in the reactor. Thus, no methanol, which could harm the surface of the heat treated objects, enters the furnace.

Furthermore, the inventive use of a gas generator guarantees that all methanol entering the gas generator is subject to the same reaction conditions. Thus, uniform and reproducible reaction and dissociation conditions are provided.

The inventive idea is to make use of the already available heat in the furnace to initiate, enhance and/or improve the dissociation of methanol. Therefore, a good heat transfer from the furnace to the gas generator and/or from the furnace atmosphere to the gas generator should be ensured. Preferably, the gas generator or at least the reactor is located inside the furnace, more preferred the gas generator or the reactor is arranged in such a way that it is essentially surrounded by the furnace atmosphere from all sides. Thereby, the heat input from the furnace atmosphere into the gas generator and into the reactor is maximised.

As mentioned above, the invention is based on the concept of using the furnace heat to enhance the dissociation of methanol in the gas generator. The gas generator shall be in heat exchange contact with the furnace and/or with the furnace atmosphere such that part of the heat from the furnace is transferred to and into the gas generator and the reactor (as part of the gas generator). Therefore, it is also possible to arrange the gas generator in direct contact with a wall of the furnace. The gas generator may even be positioned outside the furnace and some kind of heat cycle or heat transfer medium is used to transfer heat from the furnace to the gas generator. However, installation of the gas generator inside the furnace is preferred.

According to the invention, methanol, either in liquid or in evaporated state, is supplied to the gas generator and dissociated into CO and $H_2$ in the reactor. The methanol is preferably supplied to the gas generator together with gaseous nitrogen ($N_2$). Preferably, a mixture of 70-95% by weight methanol and 5-30% by weight nitrogen is used. The mixture of nitrogen and methanol, preferably evaporated methanol, is fed to the gas generator at a pressure between 0.5 bar (abs) and 4 bar (abs).

The inventive furnace comprises a heating zone and a cooling zone and said gas generator is installed in the contact area of the heating zone and the cooling zone. For example, in a continuous furnace the parts to be heat treated are first passed through a heating zone and then through a cooling zone. In that case the gas generator is placed in the region where the heating and the cooling zone abut. The carbon potential of the furnace atmosphere varies with temperature. Thus, a furnace atmosphere of a specific composition would give different carburisation/decarburisation rates during cooling and heating. By the inventive provision of the gas generator in the contact area of the heating zone and the cooling zone it is possible to provide gas (gas mixtures) of different composition to the heating zone and to the cooling zone. The gases introduced into the furnace are distributed in proportion to the conditions and requirements in each zone. The diameters of outlets, openings and pipes are preferably determined by modelling to meet the individual furnace requirements and furnace size.

The inventive gas generator comprises at least one methanol feed line for supplying liquid or evaporated methanol. Inside the gas generator (in the reactor) the methanol is dissociated to CO and $H_2$ and fed out of the gas generator and into the furnace atmosphere through one or more gas outlets. Preferably, all of said gas outlets are directed towards the cooling zone. Thereby, the CO and $H_2$ created by dissociation of methanol are essentially introduced into the cooling zone and not into the heating zone. However, it is also possible to provide outlets directed to the cooling zone as well as to the heating zone. In some cases it is advantageous to design all or some of the gas outlets as high speed jet nozzles. For example, the implementation of high speed jet nozzles in the direction of the cooling zone of a continuous furnace could improve the cooling without negatively affecting the main furnace flow.

Sometimes it could be desirable to have the cooling zone free of combustibles and carbon containing gases. In that case it is preferable to have the gas outlets of the gas generator for providing CO and $H_2$ in the direction of the heating zone only.

Often it is desirable to introduce a hydrocarbon into the furnace especially only in the heating zone. Therefore, it is preferred that at least one hydrocarbon feed line is provided to supply a hydrocarbon, preferably a gaseous or liquid hydrocarbon, to the furnace. The hydrocarbon is preferably supplied at a pressure of 1 bar (abs) or slightly above. It is further preferred to add gaseous nitrogen to the hydrocarbon, preferably in a ratio of 0 to 50%.

In a preferred embodiment the hydrocarbon feed line and the methanol feed line are at least partly arranged in a pipe-in-pipe arrangement. At least a part of the hydrocarbon feed line and of the methanol feed line form a double pipe with an inner pipe and a concentric outer pipe wherein the hydrocarbon flows in the inner pipe and the methanol in the annular space formed by the inner and the outer pipe or vice versa.

The methanol feed line ends in the reactor or is at least provided with outlets into the reactor such that the methanol is fed into the the reactor of the gas generator. In a preferred embodiment the hydrocarbon feed line runs through the interior of the gas generator. The hydrocarbon feed line preferably does not have any openings into the reactor. Thus, the hydrocarbon(s) do not enter the reactor but are directly introduced into the furnace.

It is further preferred to provide a carrier gas feed line which ends close to the outlet or the outlets of the hydrocarbon feed line. The term "close to" shall mean that the carrier gas leaving the carrier gas feed line and the hydrocarbon(s) leaving the hydrocarbon feed line interact with each other, that is, the carrier gas stream affects the hydrocarbon stream, for example the hydrocarbon(s) and the carrier gas are mixed and/or the hydrocarbon(s) are sucked into the carrier gas stream.

A carrier gas is provided via the carrier gas feed line. The gas leaving the carrier gas outlet works as a carrier gas for the hydrocarbon, especially for a gaseous or liquid hydrocarbon, and distributes the hydrocarbon in the furnace. The preferred carrier gas is nitrogen. The preferred pressure range for supplying the carrier gas is from 2 bar (abs) to 5 bar (abs). The carrier gas feed line preferably ends in a nozzle, more preferred in a high speed jet nozzle. The high speed carrier gas sucks in the hydrocarbons and distributes them homogeneously in the furnace atmosphere.

In a preferred embodiment the carrier gas feed line runs through the interior of the gas generator, but without openings into the reactor of the gas generator. It is preferred to arrange the hydrocarbon feed line and the carrier gas feed line at least partly as concentric pipes. It is in particular preferred to arrange the methanol feed line, the hydrocarbon feed line and the carrier gas feed line at least partly as concentric pipes.

The invention is in particular useful for providing a heat treatment atmosphere to a continuous furnace, in particular a sintering furnace. Use of the invention will result in lower maintenance. Often such furnaces comprise a conveyor belt or transport band or a mesh belt. It is preferred to provide the gas generator or at least the reactor with supporting stands and to arrange the gas generator or the reactor in such a way that the conveyor or mesh belt moves below the gas generator or the reactor. The support for the gas generator or for the reactor preferably comprises supporting legs which fit in the gap between the conveyor belt or mesh belt and the furnace walls.

Depending on the type of furnace and on the type of heat treatment, the temperature in the furnace might be too low to get enough heat into the gas generator and into the reactor for dissociating the methanol. Methanol could dissociate into other constituents, for example carbon dioxide ($CO_2$) and water ($H_2O$), if it is not cracked at the right temperature conditions. Therefore, it is preferred to provide the gas generator with additional heating means, in particular with electrical heating means.

For controlling the temperature conditions in the gas generator it is advantageous to provide a thermocouple in the gas generator. For example, if the temperature in the gas generator is too low, the electrical heating means could be used to add heat to the gas generator and to improve the dissociation of the methanol.

It is further advantageous to feed pre-heated nitrogen gas into the reactor. Prior to being provided to the reactor the nitrogen could be heated up to a temperature of more than 500° C., more than 600° C., more than 700° C. or more than 800° C. The heated nitrogen helps to provide the necessary energy to crack and dissociate the methanol in the reactor into the desired components CO and $H_2$.

It is also possible to put material, such as a catalyst, into the gas generator in order to activate and/or speed up the methanol dissociation.

In another preferred embodiment the outside surface of the gas generator and/or the reactor is provided with fins in order to increase the outer surface of the gas generator and to thereby increase the heat input from the surrounding furnace atmosphere into the gas generator.

The invention is in particular useful for creating a CO, $H_2$ and $N_2$ containing furnace atmosphere, especially in the cooling zone and/or in the heating zone of the furnace. Preferably, a mixture of nitrogen and methanol is introduced into the gas generator where the methanol dissociates and the desired $CO/H_2/N_2$ based atmosphere is created.

The invention has several advantages over the prior art. The invention allows to provide gas mixtures of different composition to the cooling zone and to the heating zone. Thereby, the carburisation rate and/or the de-carburisation rate in the heating zone as well as in the cooling zone can be set and controlled individually. The invention saves hydrogen costs as the dissociation of the methanol will provide enough hydrogen for the heat treatment process. Therefore, additional hydrogen can be eliminated completely. Further, the invention allows reliable carbon control, especially in sintering furnaces. The invention improves the convection in the furnace, especially in continuous furnaces and sintering furnaces, which will improve the heating and sintering times by up to 10%.

Figure 2:
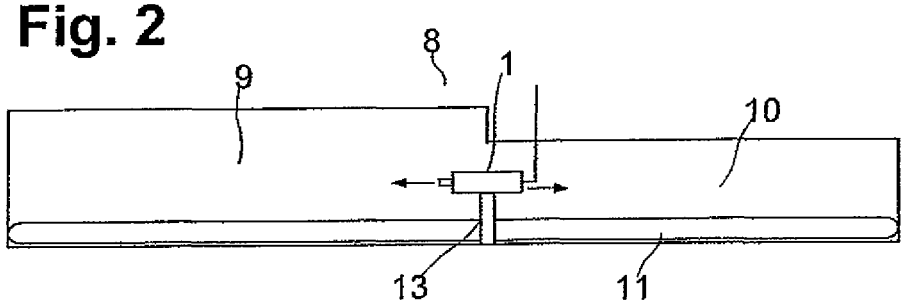
Figure 3:
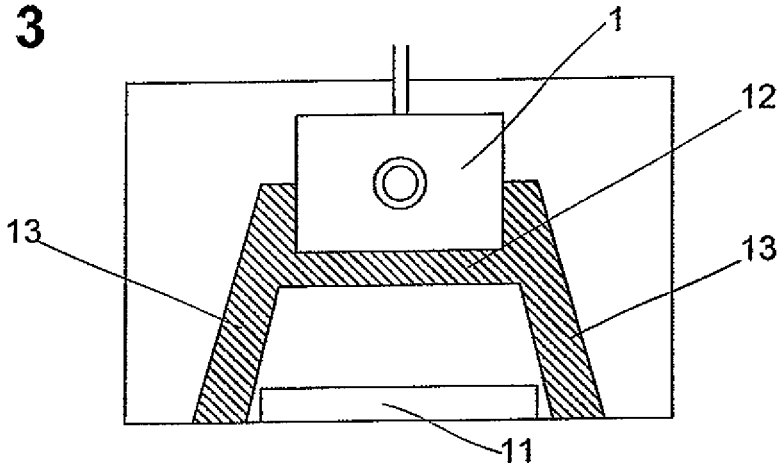
Figure 4:
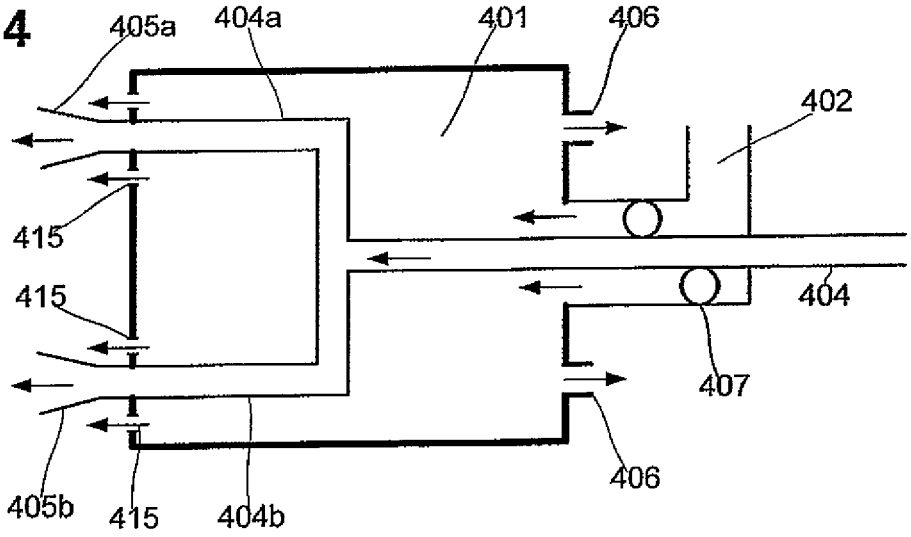
Figure 5:
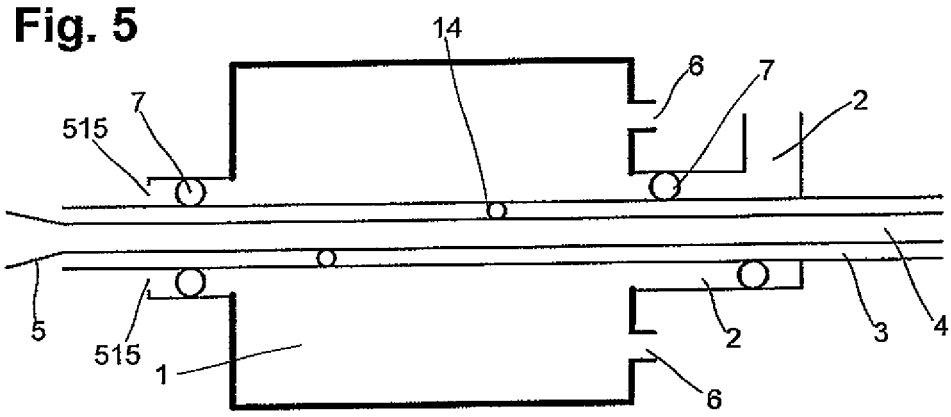

The invention as well as further details and embodiments of the invention shall now be described with reference to the attached drawings of which:

FIG. 1 schematically shows the inventive gas generator,

FIG. 2 shows a side view of a continuous furnace with the inventive gas generator, FIG. 3 shows a front view of the furnace and the gas generator, FIG. 4 shows another embodiment of the inventive gas generator and FIG. 5 shows a variation of the embodiment of FIG. 1.

FIG. 1 schematically shows a gas generator according to the invention. The gas generator comprises a box-like reactor or reactor chamber 1. The reactor 1 is connected to a methanol supply (not shown) via a methanol feed line 2. Further, a hydrocarbon feed line 3 and a carrier gas feed line 4 are provided. The hydrocarbon feed line 3 is connected to a hydrocarbon supply (not shown). The carrier gas feed line 4 ends in a nozzle 5. Preferably a gaseous or liquid hydrocarbon is used, for example methane ($CH_4$) or propane ($C_3H_8$).

Hydrocarbon feed line 3 and carrier gas feed line 4 are arranged as two concentric pipes wherein the inner pipe 4 is used as the carrier gas feed line and the annular gap between the two pipes is used as the hydrocarbon feed line 3. The double pipes 3,4 run through the interior of the gas generator, i.e. through reactor 1, without any opening or outlet towards the reactor 1.

The position of the double pipes 3, 4 relative to the gas generator and relative to the reactor 1 is fixed by balls 7. Further, balls 14 are used for centering the carrier gas feed line 4 within the hydrocarbon feed line 3. Instead of the balls 7,14, it is also possible to use other suitable spacers.

Methanol supply, hydrocarbon supply as well as carrier gas supply are preferably arranged outside furnace 8.

The reactor 1 is further provided with outlets 6 in a direction opposite to the nozzle 5, that is, carrier gas leaving the carrier gas feed line 4 through nozzle 5 and gas leaving the reactor 1 through the outlets 6 flow in essentially opposite directions.

The gas generator reactor 1 is placed into a continuous furnace 8 which comprises a heating zone 9 and a cooling zone 10, as shown in FIG. 2. The parts to be heat treated are transported through the continuous furnace 8 by means of a conveyor or mesh belt 11 in the direction from the heating zone 9 to the cooling zone 10. In the embodiment of FIG. 2 the parts move through the furnace 8 from the left to the right. The gas generator is located in the area or section where the heating zone 9 ends and the cooling zone 10 begins, that is in the section or zone where heating zone 9 and cooling zone 10 abut. The gas generator is orientated in such a way that the nozzle 5 is directed towards the heating zone 9 and the outlets 6 of the reactor 1 are directed towards the cooling zone 10.

FIG. 3 shows the arrangement of the gas generator within the furnace 8. The gas generator is supported by a framework 12. The framework 12 includes legs 13 on each side of the conveyor or mesh belt 11 such that the conveyor or mesh belt 11 can run below the framework 12.

In one embodiment, a mixture of pre-heated nitrogen gas with a temperature above 800° C. and evaporated methanol is supplied to the methanol feed line 2. It is also possible to supply liquid methanol instead of or in addition to evaporated methanol. The pressure of the nitrogen-methanol mixture is preferably in the range 0.5 bar to 4 bar. The mixture enters the reactor 1. The gas generator and in particular the reactor 1 are provided with walls having a high thermal conductivity such that a good heat transfer from the furnace atmosphere to the reactor 1 is achieved. The methanol entering the reactor 1 is subjected to the heat and dissociates into CO and $H_2$. The resulting mixture of $N_2$, CO and $H_2$ leaves the gas generator through the outlets 6 and is distributed in the cooling zone 10.

Via hydrocarbon feed line 3 a hydrocarbon, such as $CH_4$ and/or $C_3H_8$, are supplied either with or without additional nitrogen. The pressure of the hydrocarbon(s) or of the mixture of nitrogen and hydrocarbon(s) is preferably between 1 bar and 1.5 bar.

A carrier gas, preferably gaseous nitrogen, is fed through the inner pipe 4, preferably at a pressure between 2 and 5 bar. The nitrogen is introduced into the furnace 8, in particular in the heating zone 9, through nozzle 5. The nitrogen leaving the nozzle 5 at a high velocity of preferably more than 10 meters per second (m/s), more than 20 m/s, more than 30 m/s or more than 35 m/s sucks in the hydrocarbon leaving the annular gap 3 and distributes the hydrocarbon evenly within the heating zone 9.

FIG. 4 shows another preferred embodiment of the invention. Similar to FIG. 1, a reactor 401 is designed as a box-like enclosure with a methanol feed line 402 and a carrier gas feed line 404. The carrier gas feed line 404 runs through the reactor 401 without any outlet to the interior of the reactor 401. In the embodiment shown in FIG. 4, the carrier gas feed line 404 splits into two pipes 404*a*,404*b* which both end outside the gas generator 401 in nozzles 405*a*,405*b*. The carrier gas feed line 404 is centered in the methanol feed line 402 by means of balls 407 or any other kind of spacers.

The reactor 401 has first outlets 406 in a direction opposite to the nozzles 405*a*,405*b*. Similar to the embodiment according to FIG. 1, gas leaving the carrier gas feed line 404 through one of the nozzles 405*a*,405*b*, and gas leaving the reactor 401 through the outlets 406 flow in essentially opposite directions.

Reactor 401 is provided with one or more additional outlets 415 which are arranged close to the nozzles 405*a*,405*b*. Part of the gas leaves the reactor 401 through one of the additional outlets 415 in a direction essentially parallel to the carrier gas flow leaving nozzles 405*a*,405*b* and is then sucked into that carrier gas stream.

The gas generator reactor 401 is preferably arranged in the furnace in such a way that the additional outlets 415 and the nozzles 405*a*,405*b* are directed towards the heating zone 9 and the first outlets 406 are directed towards the cooling zone 10.

The gas generator reactor 401 is preferably supplied with a mixture of methanol ($CH_3OH$), either in evaporated or in liquid form, nitrogen and a hydrocarbon, preferably a gaseous or liquid hydrocarbon such as $CH_4$ or $C_3H_8$. The methanol dissociates into CO and $H_2$ within the gas generator. The resulting mixture of CO, $H_2$, $N_2$, and a hydrocarbon enters the cooling zone 10 of the furnace through the first outlets 406 and the heating zone 9 through the additional outlets 415. The gas mixture entering into the heating zone 9 will be sucked in by the carrier gas stream, which is preferably gaseous nitrogen, and homogeneously distributed in the heating zone.

FIG. 5 shows an embodiment which is identical with FIG. 1 except the additional gas outlets 515 of the reactor 1 are close to the nozzle 5. Via these additional gas outlets 515 the gas generated in the reactor 1 is also introduced into the heating zone 9 of the furnace 8.

The invention claimed is:

1. A heat treatment furnace, comprising:

a heating zone;

a cooling zone; and a gas generator disposed within the furnace and in heat exchange contact with the heating zone and the cooling zone, said gas generator including an inlet connected to a liquid methanol feed line through which liquid methanol is provided to said generator in which said liquid methanol is dissociated, and at least one gas outlet in communication with the furnace for dissociated methanol.

2. The furnace according to claim 1, wherein said at least one gas outlet is directed toward the cooling zone.

3. The furnace according to claim 1, further comprising a hydrocarbon feed line for supplying a hydrocarbon into the furnace.

4. The furnace according to claim 3, wherein said hydrocarbon feed fine and said liquid methanol feed line are at least partly arranged as a pipe-in-pipe arrangement.

5. The furnace according to claim 3, further comprising a carrier gas feed line which ends adjacent an outlet of said hydrocarbon feed line.

6. The furnace according to claim 5, wherein at least one of said carrier gas feed line and said hydrocarbon feed line extend through an interior of said gas generator.

7. The furnace according to claim 1, wherein said furnace is a continuous furnace.

8. The furnace according to claim 7, wherein the continuous furnace comprises a sintering furnace.

9. The furnace according to claim further comprising a conveyor belt, and a framework for supporting the gas generator above said conveyor belt.

10. A method for providing a heat treatment atmosphere in a furnace including a heating zone and a cooling zone, comprising:

positioning a gas generator within the furnace and in heat exchange contact with the heating zone and the cooling zone;

heating said gas generator with atmosphere from said furnace;

supplying liquid methanol to the gas generator;

dissociating said liquid methanol in said gas generator to produce CO and $H_2$; and introducing said CO and $H_2$ into said furnace atmosphere.

11. The method according to claim 10, further comprising supplying nitrogen to said gas generator.

12. The method according to claim 10, further comprising supplying a substance selected from the group consisting of a hydrocarbon, and a mixture of a hydrocarbon and nitrogen to said furnace.

13. The method according to claim 10, further comprising using the gas generator for providing another gas to the heating zone and the cooling zone.

14. The method according to claim 11, further comprising heating said nitrogen before the nitrogen is supplied to said gas generator.

15. The method according to claim 14, wherein the heating of said nitrogen is to a temperature above 500° C.

16. A heat treatment furnace, comprising:

a heating zone;

a cooling zone; and a gas generator disposed in heat exchange contact with the heating zone and the cooling zone and in direct contact with a wall of the furnace, said gas generator including an net connected to a liquid methanol feed line through which liquid methanol is provided to said generator in which said liquid methanol is dissociated, and at least one gas outlet in communication with the furnace for dissociated methanol.

17. The furnace according to claim 16, wherein said at least one gas outlet is directed toward the cooling zone.

18. The furnace according to claim 16, further comprising a hydrocarbon feed line for supplying a hydrocarbon into the furnace.

19. The furnace according to claim 18, wherein said hydrocarbon feed line and said liquid methanol feed line are at least partly arranged as a pipe-in-pipe arrangement.

20. The furnace according to claim 18, further comprising a carrier gas feed line which ends adjacent an outlet of said hydrocarbon feed line.

21. The furnace according to claim 20, wherein at least one of said carrier gas feed line and said hydrocarbon feed line extend through an interior of said gas generator.

22. The furnace according to claim 16, wherein said furnace is a continuous furnace.

23. The furnace according to claim 22, wherein the continuous furnace comprises a sintering furnace.

24. The furnace according to claim 16, further comprising a conveyor belt, and a framework for supporting the gas generator above said conveyor belt.

25. The furnace according to claim 16, wherein the gas generator is disposed within the furnace.

26. A method for providing a heat treatment atmosphere in a furnace including a heating zone and a cooling zone, comprising:

positioning a gas generator in direct heat exchange contact with the heating zone and the cooling zone;

transferring heat from the furnace to the gas generator through a heat transfer medium or optionally through a heat cycle;

heating said gas generator with atmosphere from said furnace;

supplying liquid methanol to the gas generator;

dissociating said liquid methanol in said gas generator to produce CO and $H_2$; and introducing said CO and $H_2$ into said furnace atmosphere.

27. The method according to claim 26, further comprising supplying nitrogen to said gas generator.

28. The method according to claim 26, further comprising supplying a substance selected from the group consisting of a hydrocarbon, and a mixture of a hydrocarbon and nitrogen to said furnace.

29. The method according to claim 26, further comprising using the gas generator for providing another gas to the heating zone and the cooling zone.

30. The method according to claim 27, further comprising heating said nitrogen before the nitrogen is supplied to said gas generator.

31. The method according to claim 30, wherein the heating of said nitrogen is to a temperature above 500° C.

* * * * *

UNITED STATES PATENT AND TRADEMARK OFFICE

CERTIFICATE OF CORRECTION

PATENT NO. : 9,157,682 B2
APPLICATION NO. : 13/362009
DATED : October 13, 2015
INVENTOR(S) : Akin Malas It is certified that error appears in the above-identified patent and that said Letters Patent is hereby corrected as shown below:

Title Page, delete Title Page with Illustrative Figure, and replace with new Title Page. (Figure 2 as shown below and the attached Title Page)

Fig. 2

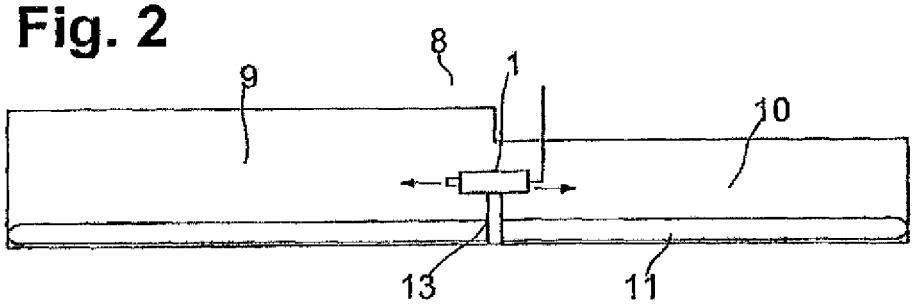

Signed and Sealed this
Twenty-third Day of February, 2016

Michelle K. Lee

Michelle K. Lee
*Director of the United States Patent and Trademark Office*

(12) United States Patent
Malas

(10) Patent No.: US 9,157,682 B2
(45) Date of Patent: Oct. 13, 2015

(54) FURNACE ATMOSPHERE GENERATOR

(75) Inventor: Akin Malas, Munich (DE)

(73) Assignee: Linde Aktiengesellschaft, Munich (DE)

( * ) Notice: Subject to any disclaimer, the term of this patent is extended or adjusted under 35 U.S.C. 154(b) by 224 days.

(21) Appl. No.: 13/362,009

(22) Filed: Jan. 31, 2012

(65) Prior Publication Data

US 2013/0026685 A1 Jan. 31, 2013

(30) Foreign Application Priority Data

Feb. 10, 2011 (EP) ..... 11001092

(51) Int. Cl.
*C21D 1/00* (2006.01)
*F27D 7/06* (2006.01)
*C21D 1/76* (2006.01)

(52) U.S. Cl.
CPC . *F27D 7/06* (2013.01); *C21D 1/763* (2013.01)

(58) Field of Classification Search
CPC ..... C21D 1/76; C21D 1/763; F27D 7/06; F27D 7/02
USPC ..... 266/44, 257
See application file for complete search history.

(56) References Cited

U.S. PATENT DOCUMENTS

| | | | | |
|---|---|---|---|---|
| 4,139,375 | A | 2/1979 | Solomon et al. | |
| 4,279,406 | A * | 7/1981 | Bourhis et al. | 266/81 |
| 4,436,289 | A * | 3/1984 | Connelly et al. | 266/80 |
| 4,643,402 | A * | 2/1987 | Brahmbhatt | 266/82 |
| 4,805,881 | A * | 2/1989 | Schultz et al. | 266/257 |
| 5,160,380 | A | 11/1992 | Vocke et al. | |
| 5,968,457 | A | 10/1999 | Van Den Sype et al. | |
| 2013/0026685 | A1 * | 1/2013 | Malas | 266/44 |

FOREIGN PATENT DOCUMENTS

| | | | |
|---|---|---|---|
| EP | 0 430 314 | A2 | 6/1991 |
| JP | 63 319201 | A | 12/1988 |

OTHER PUBLICATIONS

European Search Report, Oct. 18, 2011.
Database WPI, Week 198906, Thomson Scientific, London, GB, AN 1989-044756, XP002660825.
International Search Report for EP 11 00 1092, Date of Mailing: Oct. 18, 2011, Authorized Officer: Stefano Peis, 6 pp.
European Search Report for EP 12 00 0612, Date of Mailing: Apr. 3, 2012, Authorized Officer: Stefano Peis, 7 pp.

* cited by examiner

*Primary Examiner* — Scott Kastler
(74) *Attorney, Agent, or Firm* — Joshua L. Cohen

(57) ABSTRACT

A heat treatment furnace is provided which includes a gas generator with a methanol inlet connected to a methanol feed line and at least one gas outlet for dissociated methanol, wherein said gas generator is disposed to be in heat exchange contact with a cooling zone and a heating zone of the furnace.

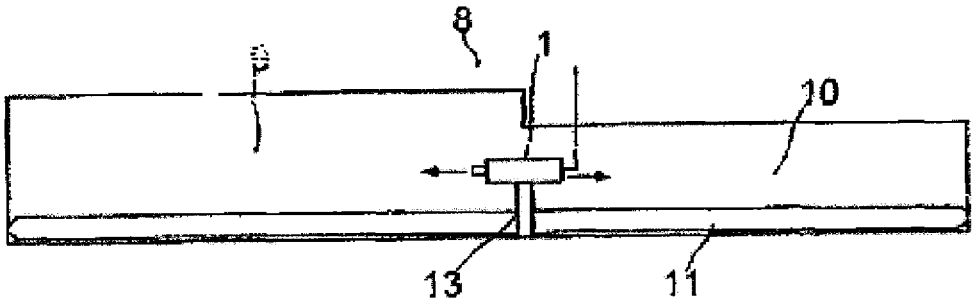

31 Claims, 3 Drawing Sheets